US009031198B2

(12) United States Patent
Roos et al.

(10) Patent No.: US 9,031,198 B2
(45) Date of Patent: May 12, 2015

(54) POWER ASSIST FOR USE OF HIGH POWER X-RAY GENERATORS TO OPERATE FROM LOW POWER SINGLE PHASE SUPPLY LINES

(71) Applicants: Hartog J. Roos, Brookfield, WI (US); Patrick J. Craney, Waukesha, WI (US)

(72) Inventors: Hartog J. Roos, Brookfield, WI (US); Patrick J. Craney, Waukesha, WI (US)

(73) Assignees: Hartog J. Roos, Brookfield, WI (US); Patrick J. Craney, Waukesha, WI (US)

( * ) Notice: Subject to any disclaimer, the term of this patent is extended or adjusted under 35 U.S.C. 154(b) by 122 days.

(21) Appl. No.: 13/952,736

(22) Filed: Jul. 29, 2013

(65) Prior Publication Data

US 2014/0056411 A1 Feb. 27, 2014

Related U.S. Application Data

(60) Provisional application No. 61/678,423, filed on Aug. 1, 2012.

(51) Int. Cl.
*H05G 1/12* (2006.01)

(52) U.S. Cl.
CPC ..... *H05G 1/12* (2013.01)

(58) Field of Classification Search
CPC ..... H05G 1/10; H05G 1/12; H05G 1/32
USPC ..... 378/101, 103, 109
See application file for complete search history.

(56) References Cited

U.S. PATENT DOCUMENTS 7,522,705 B2 4/2009 Katcha et al.
8,189,741 B2 5/2012 Ernest et al.

*Primary Examiner* — Jurie Yun
(74) *Attorney, Agent, or Firm* — Andrus Intellectual Property Law, LLP

(57) ABSTRACT

A power supply operating off a common 110/220 Volt source utilizes a number of capacitors connected in series to form a module. A number of modules are connected in series to form a bus level module. A number of bus level modules are connected in parallel to provide the voltage and power needed by an X-Ray generator.

5 Claims, 5 Drawing Sheets

POWER ASSIST FOR USE OF HIGH POWER X-RAY GENERATORS TO OPERATE FROM LOW POWER SINGLE PHASE SUPPLY LINES

CROSS-REFERENCE TO RELATED APPLICATION(S)

The present application claims priority to U.S. patent application Ser. No. 61/678,423, filed Aug. 1, 2012, the content of which is incorporated herein by reference in its entirety.

BACKGROUND

The present application relates to eliminating the need for large well regulated electrical single or three phase power and large caliber electrical supply lines required to reliably operate medium to high power X-Ray generators.

Currently there are three ways to provide the electrical power required to operate X-Ray generators:

1) Directly from heavy power lines: High frequency, medium to high power X-Ray generators transform, rectify and filter the line voltage to provide adequate DC bus voltage for inverters to power the primary of a high voltage transformer and X-Ray tube. The X-Ray generators are permanently connected to the power line and draw all energy from the power line.

2) Electrochemical Batteries: Multiple rechargeable batteries are placed in series/parallel to provide appropriate DC bus voltage and energy levels required to properly operate low to medium power X-Ray generators. The X-Ray generators are disconnected from their electrical supply source and draw all energy from the batteries during X-Ray exposures.

3) Capacitor Discharge: Store low energy and low power are stored in multiple capacitors of low capacitance. The X-Ray generators are disconnected from their electrical supply source during the X-Ray exposures and are limited to short duty cycles and X-Ray technique.

In the above three configurations the generator power output and duty cycle is limited by the capability and regulation of the power line, the battery pack or the capacitors.

Industry typically defines the power output of an X-Ray generator as to be able to deliver to an X-Ray tube during a 100 milliseconds exposure at its maximum tubecurrent at 100 kilovolts.

An X-Ray generator capable of supplying 100 kilovolts at 500 mA during 100 milliseconds would be rated at 50 kilowatt ($100\times500\times0.01=50$ kW).

For a 50 kilowatt generator to deliver its fill power and not taking into account transformation losses, a 220 volts AC power line must at least be capable to deliver 227 ampere with no more than 10% in voltage drop from no load to full load.

A battery pack for a 50 kilowatt generator with as 300 volts DC bus for the inverter must be capable of delivering at least a current of 166 amp with 10% or less in voltage drop.

SUMMARY

The system and method of the present application utilizes super capacitors with the capability to deliver high power serving as a buffer between the X-Ray generator power requirements and the electrical supply.

The present application includes a bank of super capacitors that are continuously charged from a 15 amp AC current source up to the required DC voltage for the bus voltage of an X-Ray generator inverter, without the need to disconnect from the electrical supply during X-Ray exposures.

With the system connected to a 110/220 volt line, it will sustain repeated X-Ray exposures at the generator specified power ratings, assuring a consistent power source for proper X-Ray exposures within the power rating specifications and normal duty cycle.

The system eliminates the need for heavy power lines with critical regulation requirements while reducing the well-known limitations of capacitor discharge units and maintenance cost of battery powered systems.

The system is distinguished from prior art of so-called capacitor discharge and battery assisted units in its capability to consistently operate higher power high frequency X-Ray generators from a single phase 50/60 Hertz, 110/220 Volt, 15 amp power source without limiting the X-Ray generator power output and duty cycle.

Prior art necessitates that line powered X-Ray generators of 30 kW require well regulated power lines of 220 volts capable of delivering at least 100 amp. More powerful X-Ray generators require three phase power of even higher voltage and current capabilities.

DETAILED DESCRIPTION OF THE DRAWINGS

In the present description, certain terms have been used for brevity, clearness and understanding. No unnecessary limitations are to be applied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

Super Capacitor Bank (SCB)

Figure 5:
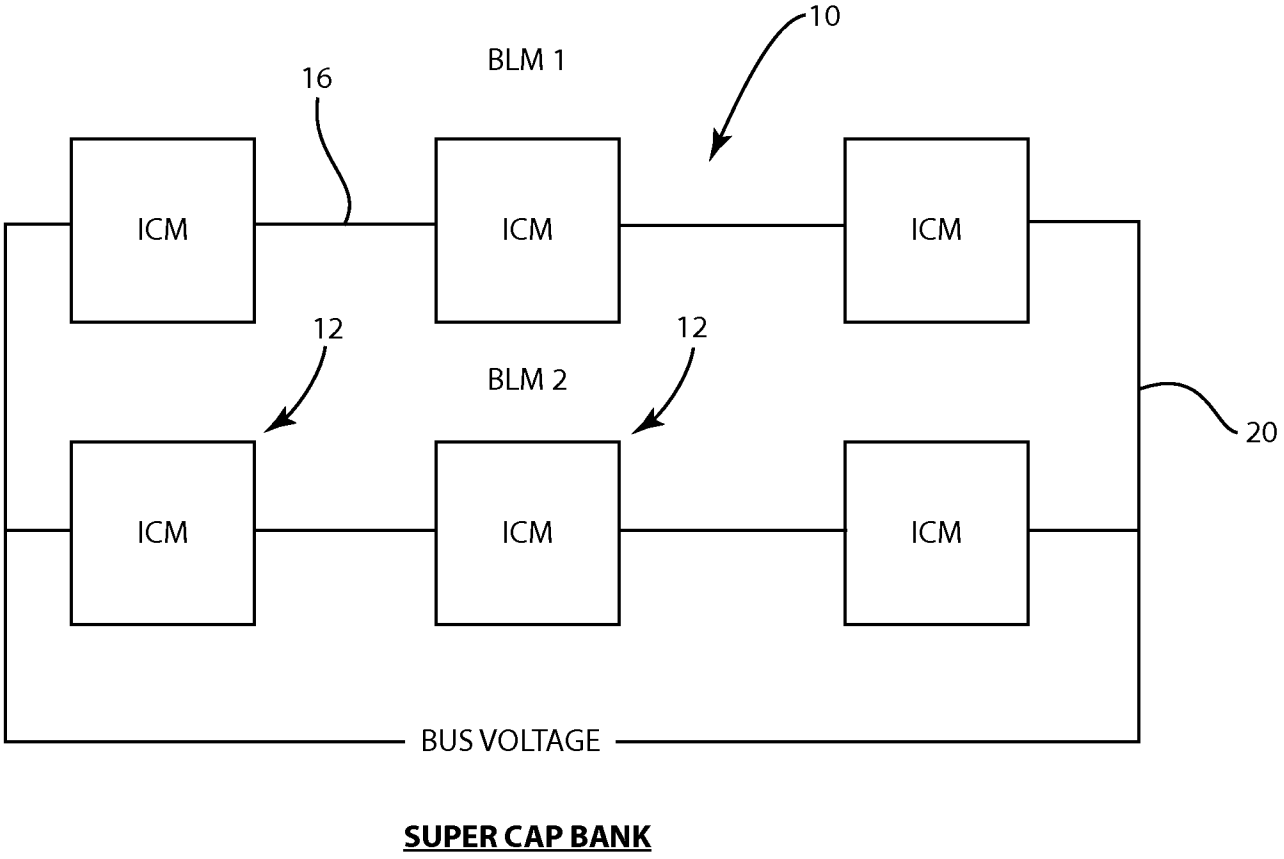
FIG. 5 is a block diagram illustrating the series and parallel connections of invention capacitor bank of the system of the present application.

Referring first to FIG. 5, the system of the present application utilizes a Super Capacitor Bank 10 ("SCB") comprising a unit containing a number of Individual Capacitor Modules 12 ("ICM"), and in one embodiment, each is rated at a total capacity of 7 Farad and 125 Volts DC.

Figure 3:
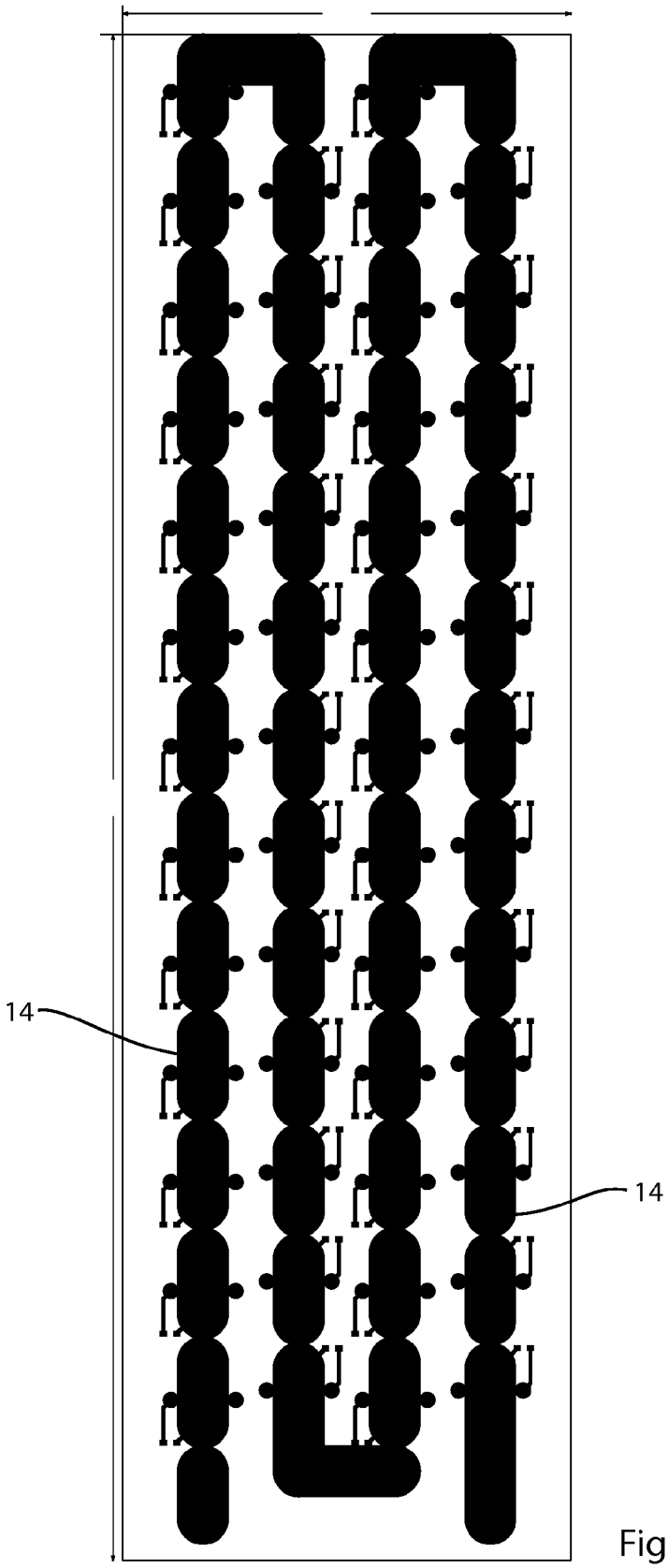
FIG. 3 is a diagram illustrating electrical connections between individual capacitors in the system of the present application.
Figure 4:
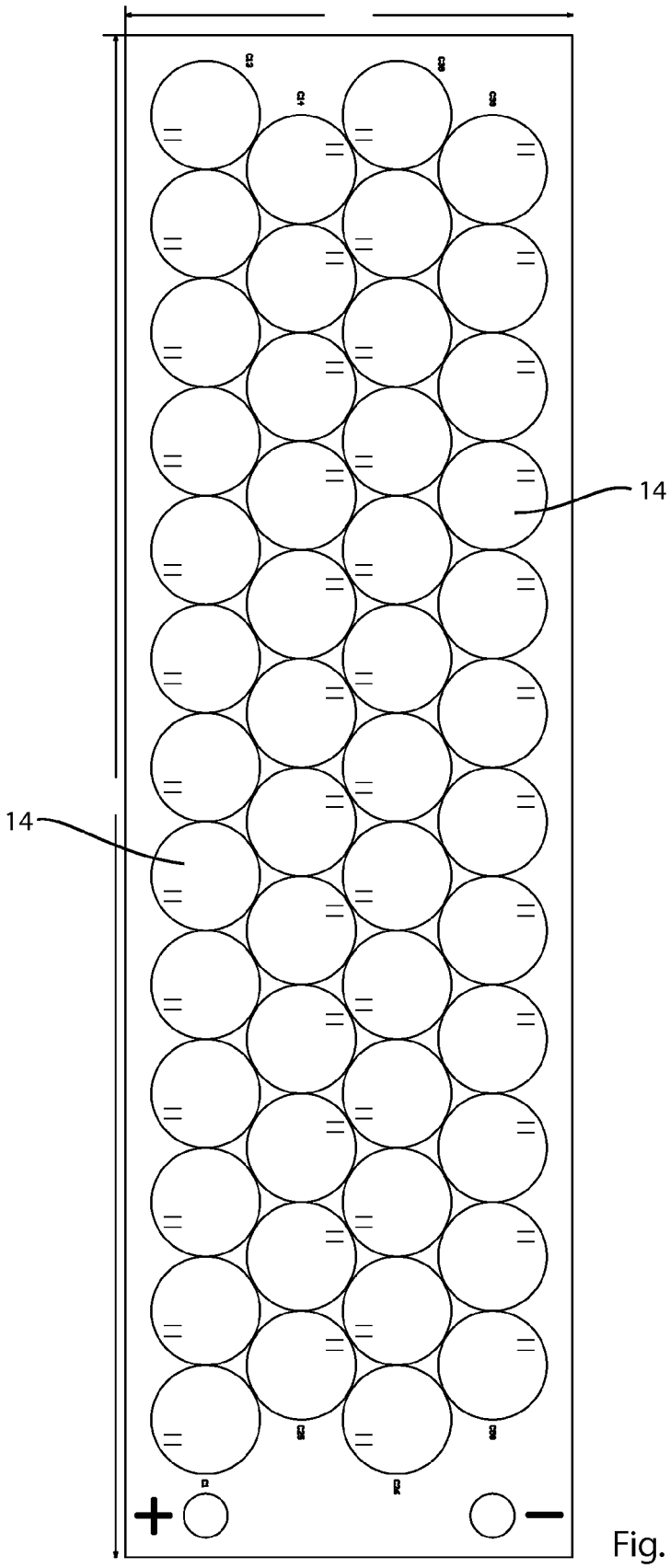
FIG. 4 is a plan view illustrating an embodiment of a capacitor bank of the system of the present application.

Referring to FIGS. 3-5, each ICM 12 includes, but is not limited to, 50 Maxwell BCAP0350 type "D boostcap ultracapacitor" 14. In one embodiment, the capacitors 14 are rated at 350 Farad and 2.7 Volts, connected in series and mounted on a printed circuit board with individual equalizing resistors.

In the embodiment shown in FIGS. 3 and 4, 50 individual capacitors 14 are connected in series in each ICM, giving it a nominal voltage rating of 125 Volts and maximum 135 Volts.

The energy storage of each ICM 12 is defined as $E=1/2CV^2=54,687.50$ Joules or Wh.

Figure 1:
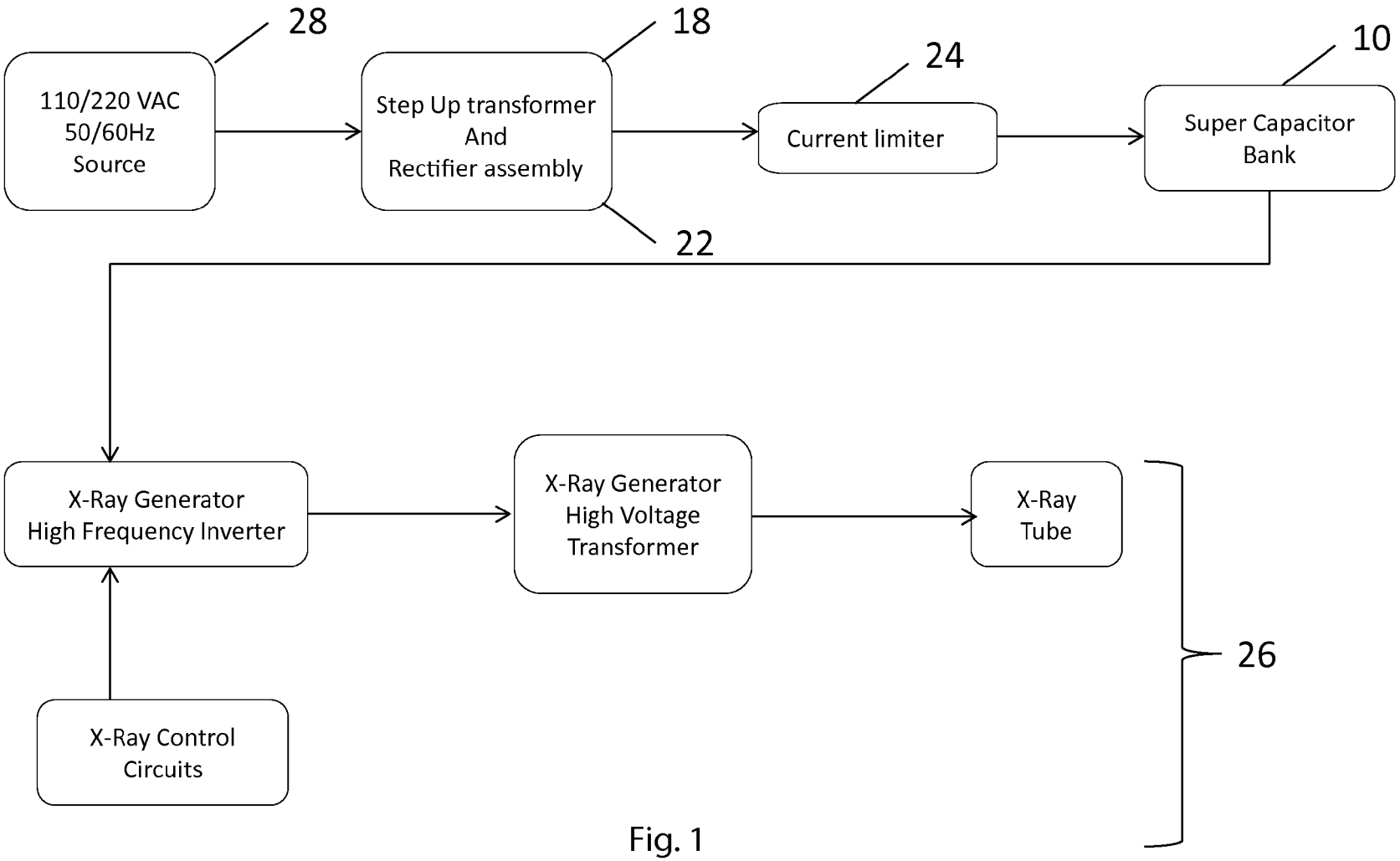
FIG. 1 is a block diagram illustrating an embodiment of the system of the present application.

A number of ICMs 12 are connected in series to meet the DC voltage requirement of the X-Ray generator inverter bus to form a Bus Level Module 16 ("BLM"). In turn, a number of BLMs 16 are connected in parallel to form the super capacitor bank 10 having a capacity required to meet the power ratings of the X-Ray generator 26 (FIG. 1). It should be noted that the X-Ray generator 26 block diagram in FIG. 1 is that of a typical X-Ray generator known in the art.

As an example, for a generator rated at 50 kW with a bus voltage requirement of 300 VDC, the power assist would contain a super capacitor bank 10 and appropriate circuitry consisting of 2 BLMs 16 with 3 ICMs 12 each, with a total capacitance of 4.66 Farad and 375 VDC maximum with a storage energy rating capacity of 209 KWh at 300 Volts.

While the power assist continuously charges at a low current rate the X-Ray generator must be provided with compensation and monitoring circuitry for the variations in allowable bus voltage.

Step-Up Isolation Transformer and Rectifier Assembly.

Referring now to FIG. 1, an exemplary embodiment of the present application is illustrated when a toroid type isolation transformer 18 is included, at the input of the power assist with an input winding tapped at 110, 120, 208 and 220 volt to connect to nominal 110/220 VAC 50/60 Hz convenience power outlets 28 rated at 15 amp.

The secondary of the isolation transformer is tapped at 220, 240 and 430 VAC for selectable input to a full wave rectifier 22 providing nominal 340 Vdc or 608 Vdc to the super capacitor bank through a charge current limiter 24.

Charge Current Limiter

The charge current limiter 24 includes resistors sized so that the capacitor charge current cannot exceed the current delivery capability of power source (15 amp) for the power assist.

Safety circuitry and visual status indicators are provided to discharge the super capacitor bank 10 in the event of external power failure or if system maintenance is required.

Detailed Circuit Description

Figure 2:
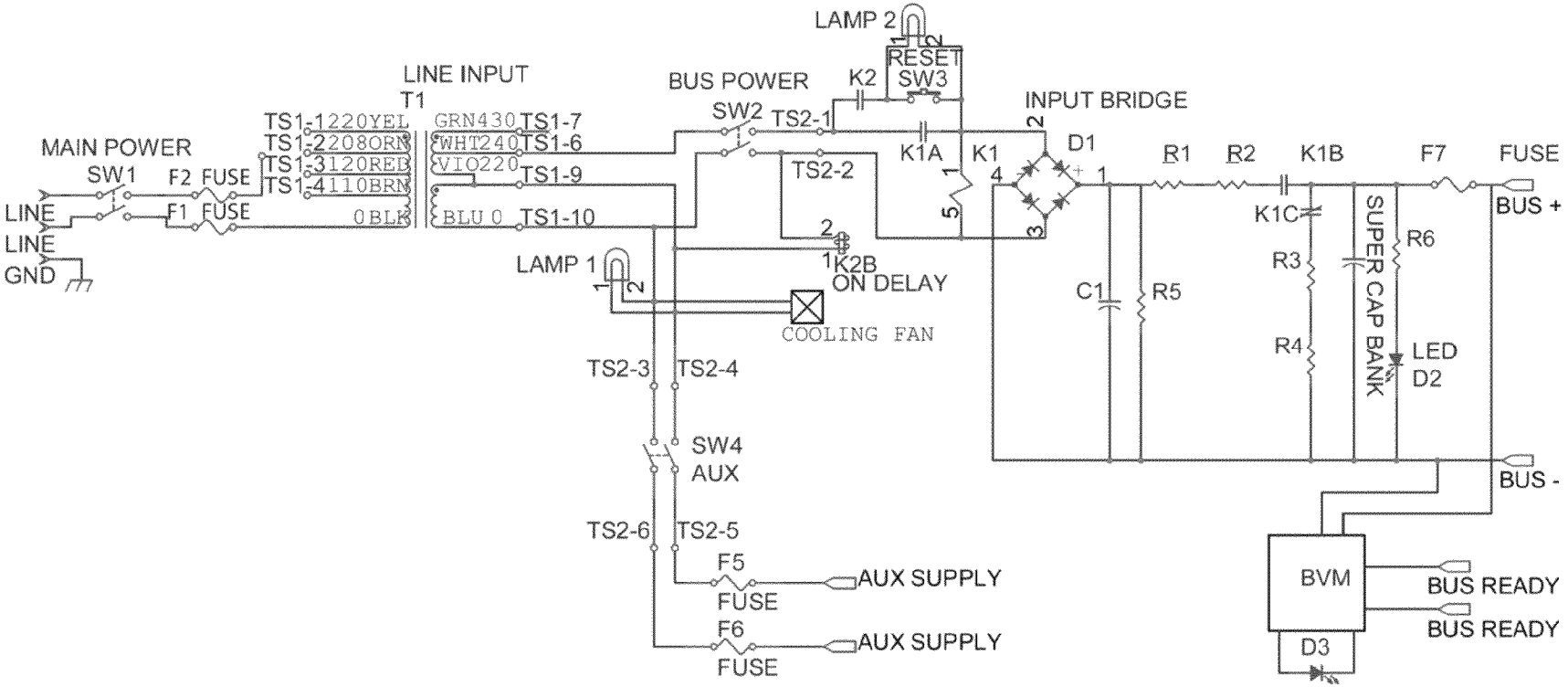
FIG. 2 is a schematic diagram illustrating a circuit embodiment utilized by the system of the present application.

Referring to FIG. 2, the power input is connected through the DPST main power switch (SW1) and main fuses (F1 and F2) to the input of step up isolation transformer (T1). Four selectable input voltage taps are provided on T1 for line input voltages of 110, 120, 208 and 240 220 VAC.

T1 secondary winding #1 provide 220 VAC for auxiliary circuits, indicators and cooling fans. Secondary winding #2 provides 240 VAC or 430 VAC through the bus power switch SW2, to the latching contact K1A of power relay K1 and the full wave bridge rectifier D1.

Turn-on delay normally opens contacts K2 in series with normally open momentary reset switch SW3 both in parallel with latching contact K1A are provided to assure that the super capacitor bank is fully discharged through resistors R3, R4 and the normally closed contacts of K1C, avoiding excessive stress and arching or flame over upon opening while the capacitor bank is being discharged.

The turn-on delay time and resistors R3, R4 are dimensioned to assure full super capacitor discharge after power failure or momentary turn-off of system prior to turning bus power on.

D3 is provided to indicate presence of charge on the super capacitor bank.

Closing switch SW1 will turn system power and lamp1 on and start cooling fans.

Closing switch SW2 will start turn-on delay K2B.

After the turn-on delay has been completed contact K2A will close indicated by turning on ready lamp 2.

Momentary closing reset switch SW3 activates contactor K1, which will latch through its normally open contacts K1A, applying AC power to full wave rectifier bridge D1.

When contactor K1 is activated a second set of normally closed contacts K1C, that have kept the super capacitors bank discharged through R3 and R4 will open.

Normally open contacts K1B will close allowing the super capacitor bank to be charged to the required bus voltage through R1 and R2 at a current rate not exceeding the limits of the AC input power line.

Led D2 indicates the presences of the bus voltage.

Led D3 indicates through bus voltage monitor ("BVM") circuits that the bus voltage is within the operating range required by the X-Ray generator.

The bus voltage monitor circuit provides a bus ready signal for the X-Ray to allow exposures.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

The invention claimed is:

1. A power supply utilizing common 110/220 volt power outlets for high power X-Ray generators comprising:

a transformer and rectifier assembly connected to the 110/220 volt power outlet;

a current limiter connected to an output of the transformer and rectifier assembly; and a capacitor bank connected to an output of the current limiter, and the output of the capacitor bank configured to supply high direct current voltage to associated X-Ray equipment.

2. The power supply of claim 1, wherein the capacitor bank comprises a plurality of capacitor modules connected in series.

3. The power supply of claim 2, wherein each of the plurality of capacitor modules includes a plurality individual capacitors connected in series.

4. The power supply of claim 2, wherein the capacitor bank has a capacity range of 310 to 700 Farads.

5. The power supply of claim 2, further comprising a plurality of capacitor banks connected in parallel to provide a desired power.

* * * * *